United States Patent [19]

Awer et al.

[11] 4,067,473

[45] Jan. 10, 1978

[54] NON CONTAMINATING MEANS FOR REMOVING STOPPERS

[76] Inventors: Erika Awer, 825 W. 187th St., New York, N.Y. 10033; John J. McMorrow, 55 Florence Ave., Oyster Bay, N.Y. 11771

[21] Appl. No.: 793,876

[22] Filed: May 4, 1977

[51] Int. Cl.[2] ..... B65D 51/20; B65D 51/22

[52] U.S. Cl. ..... 215/226; 215/296; 215/303

[58] Field of Search ..... 215/226, 296, 211, 213, 215/219, 220, 302, 303, 354, 355

[56] References Cited

U.S. PATENT DOCUMENTS

| | | | |
|---|---|---|---|
| 1,615,150 | 1/1927 | Vallens | 215/296 X |
| 2,801,017 | 7/1957 | Cortat | 215/296 |

*Primary Examiner*—George T. Hall

*Attorney, Agent, or Firm*—James P. Malone

[57] ABSTRACT

Non contaminating stopper remover means for removing test tube stoppers of the type having a center portion extending into the test tube and an upper portion having a continuous edge over the edge of the test tube stopper remover. A hollow cylindrical member has an open end adapted to fit over the stopper inserted in the test tube. The stopper remover may have an inwardly extending rim or binding surface adapted to fit the extending upper portion of the stopper so that the stopper may be removed by slipping the stopper remover over the stopper and squeezing, pulling or bending to one side of the test tube. The stopper remover is longer than the stopper so that when the stopper is removed any contamination by the stopper is prevented.

4 Claims, 3 Drawing Figures

FIG 2
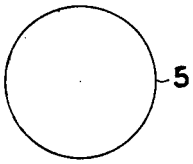
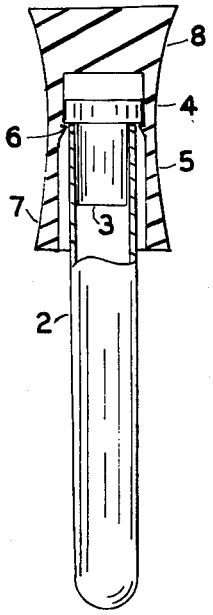
FIG 1
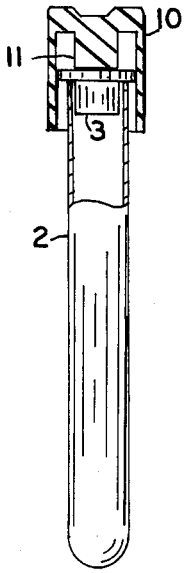
FIG 3

NON CONTAMINATING MEANS FOR REMOVING STOPPERS

This invention relates primarily to stoppers for medical test tubes and more particularly to means for removing stoppers which will prevent contamination of medical technicians when the stopper is removed and secondarily to the removing of stoppers from any tube containing any substance that may be a contaminant.

One of the problems in testing blood and other samples in laboratories is that the test tube stoppers become contaminated by the contents of the tube so that when the technician removes the stopper to perform the test, the technican is likely to be contaminated by the stopper or indirectly by the surface where the stopper is deposited. This results in a high incidence of hepatitis among the medical technicians and the non-containment of various other contaminants.

The present invention solves this problem by providing a hollow stopper remover member for removing the stopper so that when the stopper is removed the part of the stopper that fits inside the test tube will be retained and will not be able to come in contact with anything.

Accordingly, a principal object of the invention is to provide a means to prevent contamination by stoppers for medical test tubes.

Another object of the invention is to provide new and improved means for removing stoppers for test tubes.

Another object of the invention is to provide new and improved non-contaminating means for removing test tube stoppers of the type having a center portion extending into the test tube and an upper portion having a continuous edge over the edge of the test tube comprising, a hollow cylindrical member having an open end adapted to fit over a stopper inserted in a test tube, the hollow member may have an inwardly extending rim or binding surface adapted to fit the extending upper portion of the stopper so that the stopper may be removed by slipping the hollow member over the stopper and squeezing, pulling and/or bending the hollow member. The hollow member being longer than the stopper prevents the stopper from causing contamination when removed.

These and other objects of the invention will be apparent from the following specification and drawings of which:

FIG. 1 is a side view of an embodiment of the invention partly in section.

FIG. 2 is a top view of the embodiment of FIG. 1.

FIG. 3 is a side section view of another embodiment of the invention.

Referring to the figures, a conventional stopper 1, is shown inserted in a test tube 2. The stopper has an internal portion 3 which extends into the test tube and an upper portion 4, which extends out over the edge of the test tube. In practice, when the conventional stoppers are removed the internal portion 3 is generally contaminated by the contents of the test tube and this contamination is likely to get on the hands of the technician or on the table where the stopper is placed.

The stopper remover of the present invention comprises an elongated hollow cylindrical member 5 which is open at one end so as to fit over the stopper inserted in the test tube. The hollow removing member may have an internal rim 6, or binding surface which is adapted to fit the extending edges of the portion 4 of the stopper 1. The non-contaminating means 5 may be pulled or pushed to the side in order to remove the stopper. The upper portion of the non-contaminating means can be easily gripped by the fingers of the user. The stopper 1 will be retained inside the removing member 5 by the internal rim 6. The extending end 7 of the stopper remover extends considerably past the contaminated end 3 of the stopper. Therefore the contamination will not come in contact with the fingers of the user and will not come in contact with the fingers of the user and will not come in contact with any surface upon which the contaminated stopper is placed.

FIG. 3 shows another embodiment of the invention wherein the stopper remover 10 is internally shaped to have a plug 11 so that if the stopper 3 is removed the stopper remover 10 may be used as a stopper. It is claimed:

1. Non-contaminating means for removing test tube stoppers of the type having a center portion extending into the test tube and an upper portion having a continuous edge extending over the edge of the test tube comprising, a hollow cylindrical member having an open end adapted to fit over a stopper inserted in a test tube so that the stopper may be removed by slipping the hollow member over the stopper and squeezing, pulling and bending the hollow member to the side, the hollow member being longer than the stopper so that when the stopper is removed any contamination on the stopper will not be able to touch anything.

2. Apparatus as in claim 1 wherein the hollow member has an inwardly extending rim adapted to fit under the extending edge of the upper portion of the stopper.

3. Apparatus as in claim 2, wherein the inwardly extending rim is dimensioned to snap over the extending edge of the stopper so as to retain the stopper inside the hollow member after the stopper has been removed.

4. Apparatus as in claim 1 wherein the cylindrical stopper remover member is internally shaped so that it can function as a stopper after the stopper has been removed.

* * * * *